United States Patent [19]

Sumigawa

[11] Patent Number: 4,954,107

[45] Date of Patent: Sep. 4, 1990

[54] TILT CYLINDER DEVICE

[75] Inventor: Yukio Sumigawa, Hamamatsu, Japan

[73] Assignee: Sanshin Kogyo Kabushiki Kaisha, Hamamatsu, Japan

[21] Appl. No.: 365,665

[22] Filed: Jun. 13, 1989

[30] Foreign Application Priority Data

Jun. 13, 1988 [JP] Japan ..... 63-143504

[51] Int. Cl.[5] ..... B63H 5/12

[52] U.S. Cl. ..... 440/61; 248/641; 440/63

[58] Field of Search ..... 440/53, 55, 56, 61, 440/63, 65, 900, 113; 248/640–643

[56] References Cited

U.S. PATENT DOCUMENTS

| | | | |
|---|---|---|---|
| 3,722,455 | 3/1973 | Carpenter | 440/61 X |
| 4,419,083 | 12/1983 | Taguchi | 440/61 X |
| 4,687,448 | 8/1987 | Peirce | 440/61 X |

*Primary Examiner*—Joseph F. Peters, Jr.
*Assistant Examiner*—Edwin L. Swinehart
*Attorney, Agent, or Firm*—Ernest A. Beutler

[57] ABSTRACT

A tilt cylinder device for a tiltable outboard drive unit on a marine vessel positioned so that the stress acting on the tilt cylinder device and its associated parts is decreased when the drive unit collides with an underwater obstacle. The tilt cylinder device is also positioned so that the stop pin, used for setting the downward tilt position of the drive unit, is not obstructive to the removal of the tilt cylinder device.

20 Claims, 4 Drawing Sheets

TILT CYLINDER DEVICE

BACKGROUND OF THE INVENTION

The invention relates to a tilt cylinder device for a marine drive unit, such as an outboard engine or the outboard drive portion of an inboard/outboard engine for boats, rafts and other marine vessels positioned so that the stress acting on the tilt cylinder device and its associated parts is decreased.

One form of an outboard drive unit is attached to the hull of a marine vessel by a clamp bracket and an elongated swivel bracket secured to the clamp bracket by a tilt shaft that allows the drive unit to be selectively tilted downwardly into, or upwardly out of, the water. This type of swivel bracket is normally used on vessels having a high transom such as a sail boat.

A lower positioned stop pin, engageable with the swivel bracket, is used for deciding the downward position of the swivel bracket and the trim adjustment. In order to perform satisfactorily the tilt cylinder device should preferably be capable of maintaining the drive unit in a downward position during normal operation so that the drive unit does not swing upwardly due to the thrust of the propeller when the vessel is driven in the reverse direction. The tilt cylinder device should preferably also prevent the drive unit from being swung upwardly by the resistance of the water when the vessel suddenly decelerates or stops. In order to minimize damage to the drive unit, however, the tilt cylinder device preferably should allow the drive unit to swing upwardly in the event of a collision with a submerged object.

Previous tilt cylinder devices typically attempt to perform some or all of the above functions. Such tilt cylinder devices are generally connected at one end to the swivel bracket and at the other end to the clamp bracket at a position between the axis about which the swivel bracket rotates and the stop pin for the purpose of reducing the size of the clamp bracket. However, such tilt cylinder device arrangements have been unsuccessful in reducing the stress which acts on the tilt cylinder device and its associated support members during collision.

SUMMARY OF THE INVENTION

A tilt cylinder device in an outboard drive unit positioned so as to decrease the stress acting on the tilt cylinder device and its associated parts. Preferably the outboard drive unit includes a clamp bracket attached to the hull of a marine vessel, a swivel bracket rotatably secured to the clamp bracket for movement of the drive unit by a tilt shaft about a tilt axis. Preferably the outboard drive unit also includes a stop pin receivable within a series of apertures in the clamp bracket for setting the downward position of the swivel bracket. Preferably the tilt cylinder device is secured at one end to the swivel bracket and secured at the other end to the clamp bracket at a position more remote from the tilt axis than the position where the stop pin is received within the clamp bracket.

Alternatively, the tilt cylinder device is pivotally connected at one end to the swivel bracket and pivotally connected at the other end to the clamp bracket such that the perpendicular distance from the tilt axis to a line extending between the pivotal connections is greater than the distance between the tilt axis and the position where the stop pin is received within the clamp bracket.

DETAILED DESCRIPTION OF THE PREFERRED EMBODIMENTS

For purposes of describing and illustrating the principles and function of the invention, the drawings illustrate an outboard motor, generally referred to herein as a drive unit. The invention is not so limited, however, as it is equally applicable to vessels having inboard engines with outboard drive apparatus as well as other vessels having vertically pivotable drive configurations.

Figure 1:
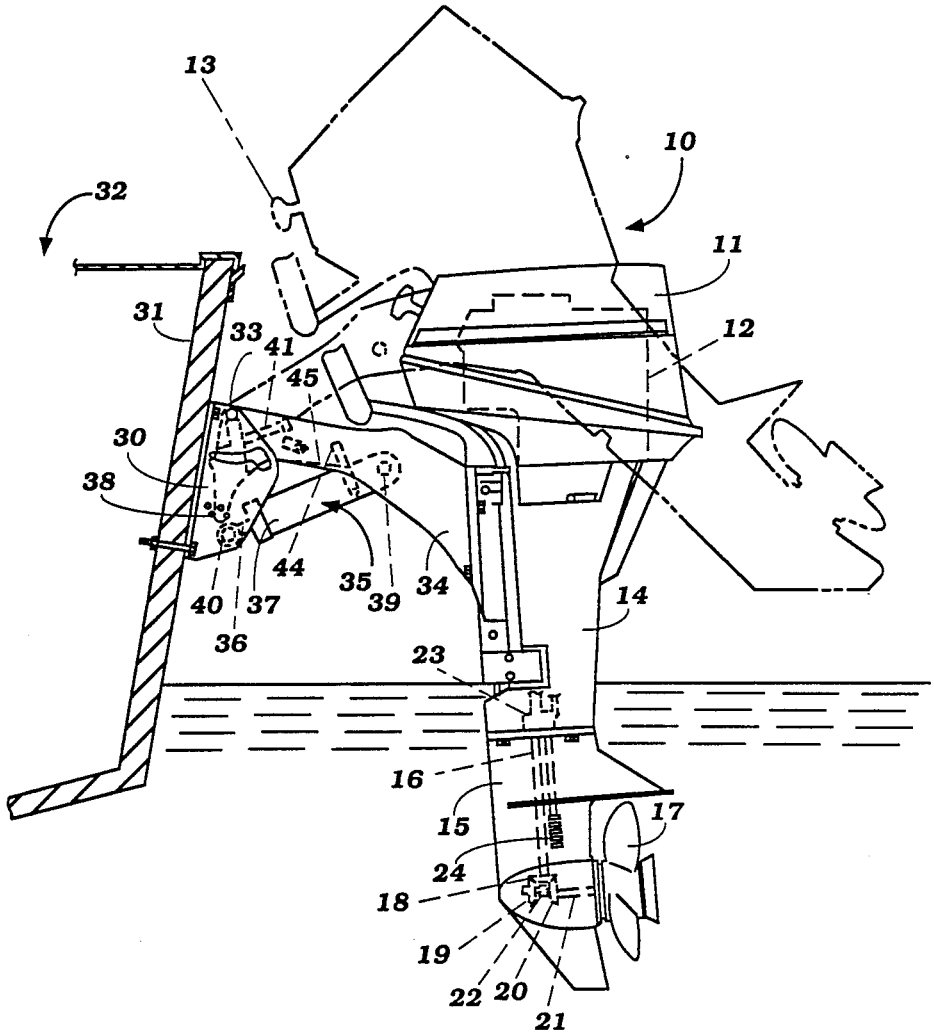
FIG. 1 is a left-side elevational view of an outboard drive unit including a tilt cylinder device embodying the invention, cut away in part and parts shown in section.

FIG. 1 illustrates a typical outboard drive unit 10 having a power head 11 including an engine 12, and a starter knob 13, a drive shaft housing 14 and a lower unit 15. The lower unit 15 includes a drive shaft 16 which is journaled within the lower unit 15 by means of support bearing (not shown) and is driven at the upper end thereof by the engine 12 in a known manner.

A forward, neutral, reverse transmission is positioned within the lower unit 15 for selectively driving a propeller 17 in forward or reverse directions. This forward, neutral, reverse transmission is comprised of a driving bevel gear 18 that is affixed to the lower end of the drive shaft 16. The driving bevel gear 18 is in mesh with a pair counterrotating driven bevel gears 19 and 20. These driven bevel gears 19 and 20 are journaled upon an intermediate shaft (not shown) by means of spaced antifriction bearings (not shown). The intermediate shaft is connected to the propeller shaft 21, which, in turn, is affixed to the propeller 17 by means of an elastic coupling. Supported on the intermediate shaft is a dog clutching sleeve 22 that has a splined connection to the intermediate shaft for rotation with this shaft and axial movement along it. The dog clutching sleeve 22 has oppositely facing dog clutching teeth that are adapted to cooperate with complementary dog clutching teeth formed on gears 19 and 20 for selectively coupling the gears 19 or 20 for rotation with the intermediate shaft.

The drive unit 10 is provided with a cooling system of the water cooled type. The cooling system includes a circulating pump 23 that is driven by the engine 12 of the drive unit 10 in a suitable manner and which circulates coolant through the engine cooling jacket for discharge back into the body of water in which the watercraft is operating along with the exhaust gases from the engine. The cooling system further includes a water intake port 24 that is formed in the lower unit 15 of the drive unit 10 and which communicates with an internal passageway that is formed within the housing of the lower unit 15 by means of integral passageway. The internal passageway communicates with the circulating pump 23 by means of a series of conduits.

The drive unit also includes a clamp bracket 30 attached to the hull 31 of a marine vessel 32, a tilt shaft 33 and a swivel bracket 34 rotatably secured at one end to the tilt shaft 33 for movement of the drive unit 10 about a tilt axis between a tilted-down position wherein the propeller 17 is positioned beneath the water and a tilted-up position wherein the propeller 17 is out of the water. The swivel bracket 34 is secured at the other end to a steering shaft (not shown) fixed to the drive shaft housing 14 for steering movement.

The outboard drive unit 10 also includes a tilt cylinder device 35, having a rod 36 and a cylinder 37, connected at one end to the clamp bracket 30 and connected at the other end to the swivel bracket 34, to maintain the drive unit 10 in a downward position during normal operation but to permit the drive unit 10 to swing upwardly in the event of a collision with a submerged obstacle. The tilt cylinder device 35 is illustrated in detail in FIGS. 2, 3 and 4. Drive unit 10 is illustrated in solid lines in its down position, and in broken lines in its up, or lifted position, in FIG. 1.

Figure 2:
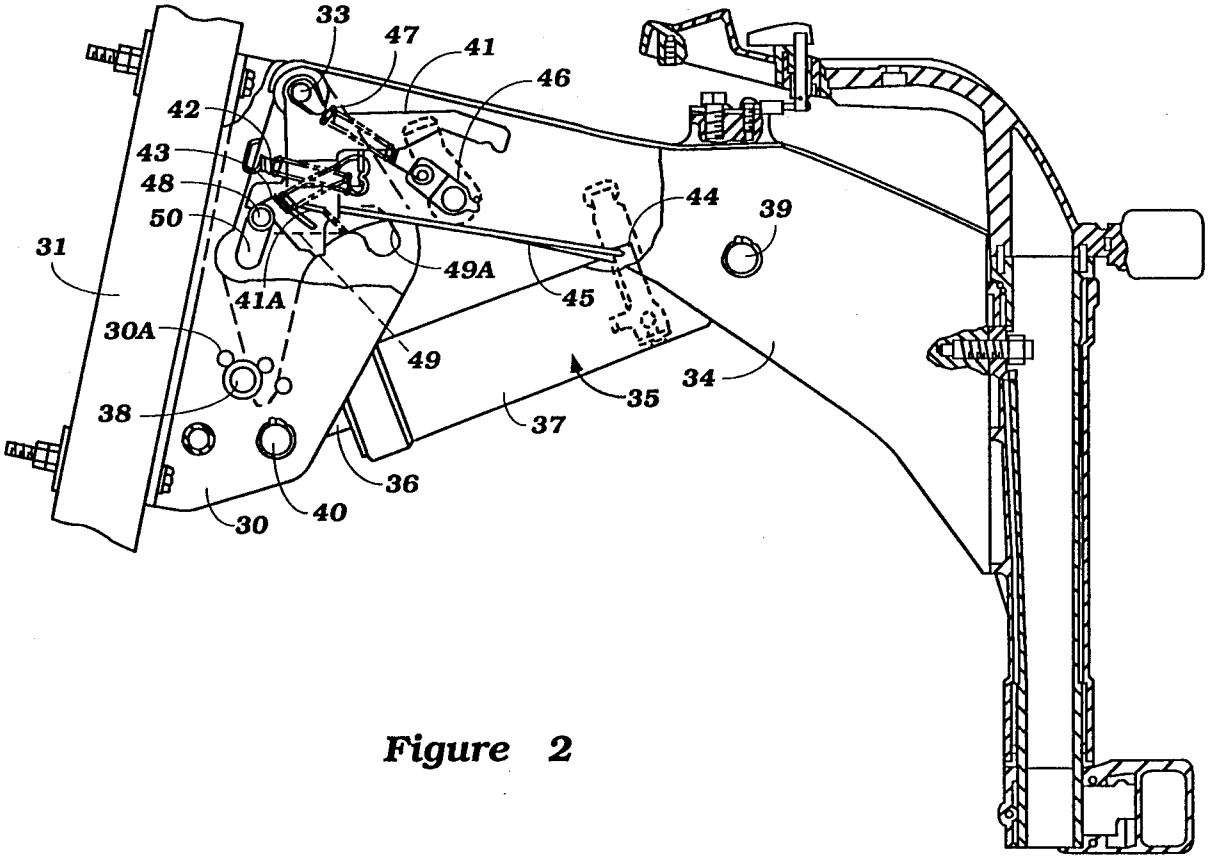
FIG. 2 is an enlarged detail view of the pivotable support assembly of the outboard drive unit including the tilt cylinder device, cut away in part and parts shown in section.

In FIG. 2, the drive unit 10 is attached to the hull 31 of a marine vessel 32, by the clamp bracket 30, the tilt shaft 33 and the swivel bracket 34 rotatably secured at one end to the tilt shaft 33 for movement of the drive unit 10 about a tilt axis between a tilted-down position wherein the propeller 17 is beneath the water and a tilted-up position wherein the propeller 17 is out of the water. The swivel bracket 34 is secured at the other end to the drive shaft housing 14 for steering movement.

The clamp bracket 30 has a series of trim apertures 30A, 30B, 30C and 30D extending laterally therethrough for receiving a lower position stop pin 38 therein for setting the downward position of the swivel bracket 34 and the trim adjusted position. Thus, the angle of the drive unit 10 with respect to the hull 31 of the marine vessel 32 may be selectively varied by the operator in accordance with desired operating conditions merely by inserting the stop pin 38 in the appropriate trim apertures 30A, 30B, 30C or 30D in the clamp bracket 30.

The tilt cylinder device 35 extendably connects the clamp bracket 30 with the swivel bracket 34. The cylinder 37 of the tilt cylinder device 35 is pivotally connected or secured to the swivel bracket 34 by a first connecting pin 39. The rod 36 of the tilt cylinder device 35 is pivotally connected or secured to the clamp bracket 30 by a second connecting pin 40.

The rod 36 is pivotally connected to the clamp bracket 30 at a position more remote from the tilt axis than the position where the stop pin 38 is secured to the clamp bracket 30 for decreasing the stress acting on the tilt cylinder device 35 and its associated parts. Alternatively, the tilt cylinder device 35 is positioned so that the perpendicular distance from the tilt axis to a line extending between the first connecting pin 39 and the second connecting pin 40 is greater than the distance between the tilt axis and the position where the stop pin 38 is secured to the clamp bracket 30, and the tilt cylinder is further positioned such that a line segment extending between the pins 39 and 40 does not intersect any line segments extending between the tilt axis and the stop pin 38 for decreasing the stress acting on the tilt cylinder device 35 and its associated parts.

A tilt lock arm 41 is rotatably supported about the tilt shaft 33. First and second springs 42 and 43 are provided for rotating the lock arm 41 in a lock position when the swivel bracket 34 is in the tilted-up position. When the lock arm 41 is in the lock position, an upper position stop pin 48, engageable with both a clamp bracket slot 49 and a swivel bracket slot 50, is engaged with a stop surface 49A of the clamp bracket slot 49 so that the swivel bracket 34 is prevented from moving. In such a case, the swivel bracket 34 is prevented from moving in the down direction by the action of the upper position stop pin 48. The swivel bracket 34 is prevented from moving toward the up direction by the closure of a bypass valve 60 (see FIGS. 3 and 4). A lever 44 is connected to the bypass valve 60 for opening and closing the bypass valve 60. A connecting link 45 extends between the lock arm 41 and the lever 44 so that the movement of the lock arm 41 to the lock position causes the bypass valve 60 to be closed.

A manual lever 46 and a third spring 47 are provided for shifting the lock arm 41 from the lock position to a release position, thereby allowing the swivel bracket 34 to be rotated to the tilted-down position. In this case, the connecting link 45 does not transmit the rotation of the lock arm 41 to the lever 44 because of the slot 41A positioned in the lock arm 41. Thus, the bypass valve 60 remains in the closed position when the swivel bracket 34 is in the tilted-down position. The swivel bracket 34 is prevented from moving toward the down direction by the action of the lower position stop pin 38 and toward the up direction by the closure of the bypass valve 60.

Figure 3:
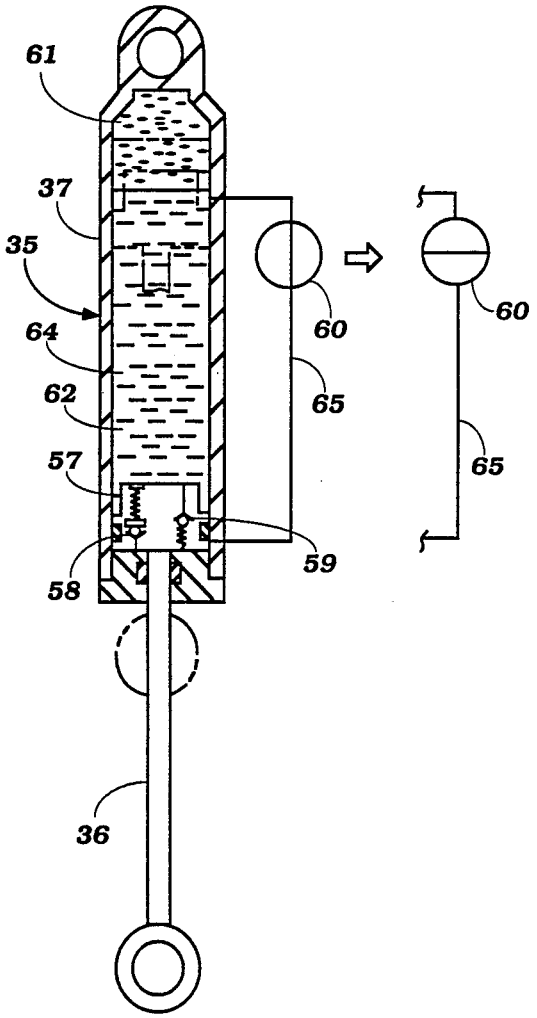
FIG. 3 is a schematic cross-sectional view of the position of a tilt cylinder device when the outboard drive unit is raised to its fully lifted position.
Figure 4:
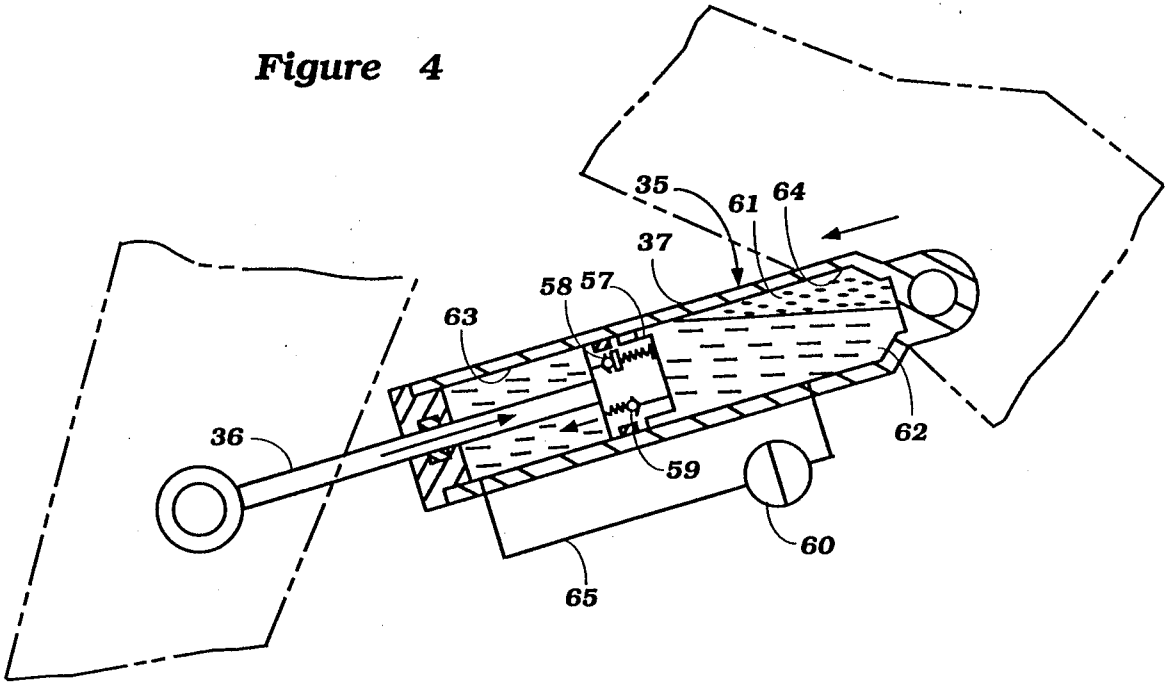
FIG. 4 is a schematic cross-sectional view of the position of the tilt cylinder device as it lowers the outboard drive unit back to its normal running position after it has cleared a submerged obstacle.

The function of the tilt cylinder device 35 is shown in FIGS. 3 and 4. When a piston 57 is fully retracted upwardly into the cylinder 37, a bypass valve 60 is closed, and as assist gas 61 is compressed, such as would occur when the drive unit 10 is lowered into its down or running position shown in solid lines in FIG. 1. In this condition, any rearwardly directed forces on the drive unit 10 such as those normally resulting from decelerating of the vessel or running the drive unit 10 in reverse would tend to urge the cylinder 37 in an upward direction relative to the rod 36 and the piston 57. When the bypass valve 60 is closed, a working fluid 62 in an annular chamber 63 cannot flow through a bypass passage 65, and thus downward force of the piston 57 causes the working fluid pressure in the annular chamber 63 to increase. However, the increased pressure in the annular chamber 63 resulting from such rearward forces on the drive unit 10 is nor normally sufficient to open a first check valve 58. Therefore, the working fluid 62 in the annular chamber 63 is trapped, and any upward movement of the cylinder 37 relative to the piston 57 is resisted, thereby maintaining the drive unit 10 in its downward or running position.

When the operator has opened the bypass valve 60 so as to tilt the drive unit 10 upwardly to its lifted position, shown in broken lines in FIG. 1, for purposes of service or maintenance, the cylinder 37 is extended upwardly, thus reducing the volume of the annular chamber 63. The reduction of volume in the annular chamber 63 forces the working fluid 62 through the bypass passage 65 into a cylindrical chamber 64.

If the drive unit 10 is tilted to its fully lifted position, the cylinder 37 moves upwardly such that the rod 36 and piston 57 force virtually all of the working fluid 62 into the cylindrical chamber 64, as illustrated in FIG. 3. The upward movement of the cylinder 37 is assisted by the pressure of the assist gas 61 to relieve the operator from the necessity of lifting the full weight of the drive unit 10. The pressure is not so high, however, to lift the drive unit 10 by itself. The assist gas 61 also expands to fill the volume of the cylinder 37 that is no longer occupied by the portion of the rod 36 that has extended out of the cylinder 37.

If the operator closes the bypass valve 60 while the rod 36 and the piston 57 are in an extended position and then releases the drive unit 10, the weight of the drive unit 10 exerts a force on the cylinder 37 in a downward direction relative to the piston 57. Such force is great enough to pressurize the cylindrical chamber 64 sufficiently to open a second check valve 59. The working fluid 62 is thus allowed to flow from the cylindrical chamber 64 through the second check valve 59 into the annular chamber 63, thereby allowing the rod 36 and the piston 57 to retract and dampingly lower the drive unit 10 to its down position. As the rod 36 and the piston 57 retract, the assist gas 61 is compressed to compensate for the volume of the cylinder 37 that is now occupied by the retracted rod 36.

In the event that the drive unit 10 collides with a submerged obstacle and the bypass valve 60 is closed, such a collision causes a sudden upward force on the cylinder 37, thereby increasing the working fluid pressure in the annular chamber 63 sufficient to open the first check valve 58. As a result, the working fluid 62 in the annular chamber 63 is forced through the first check valve 58 into the cylindrical chamber 64. The cylinder 37 extends upwardly, allowing the drive unit 10 to swing upwardly to prevent, or at least minimize, the impact damage to the drive unit 10. As the cylinder 37 extends upwardly, the assist gas 61 expands to compensate for the volume of the cylinder 37 formally occupied by the rod 36.

After the vessel has passed the submerged object and the drive unit 10 is released, the weight of the drive unit 10 urges the cylinder 37 downward relative to the piston 57, thus closing the first check valve 58 and pressurizing the cylindrical chamber 64 sufficiently to open the second check valve 59, as illustrated in FIG. 4. The working fluid 62 in the cylindrical chamber 64 is then forced through the second check valve 59 into the annular chamber 63, allowing the cylinder 37, to retract downwardly and dampeningly return the drive unit 10 to its lowered or its running position.

The foregoing descriptions represent merely exemplary embodiments of the invention. Furthermore, although the invention is described herein within the context of outboard marine drive units, the invention is not limited to such an application. One reasonably skilled in the art will readily recognize that the invention is equally applicable to other apparatus or systems having tiltable or pivotably articulated elements. Finally, various changes or modifications may be made in said embodiments without departing from the spirit or scope of the invention.

I claim:

1. An outboard drive unit carrying propelling means for propelling a marine vessel having a hull through the water, said outboard drive unit further comprising, a clamp bracket attached to the hull of said vessel, a tilt shaft, a swivel bracket rotatably secured to said clamp bracket by said tilt shaft about a tilt axis, a stop pin secured to said clamp bracket for setting the downward position of said swivel bracket, and a tilt cylinder device pivotally connected at one end to said swivel bracket and pivotally connected at the other end to said clamp bracket such that a line segment extending between said pivotal connections does not intersect any line segments extending between said tilt axis and the position where said stop pin is secured to said clamp bracket for decreasing the stress acting on the tilt cylinder device and its associated parts, said tilt cylinder device being adapted to maintain the drive unit in the downward position when the propelling means of the drive unit is operated in reverse.

2. An outboard drive unit as recited in claim 1, wherein said tilt cylinder device is positioned so that said stop pin is not obstructive to the removal of said tilt cylinder device.

3. An outboard drive unit as recited in claim 2, further comprising a first connecting pin for connecting said tilt cylinder device at one end to said clamp bracket, and a second connecting pin for connecting said tilt cylinder device at the other end to said swivel bracket.

4. An outboard drive unit as recited in claim 3, wherein said tilt cylinder device includes a cylinder, a piston, and a rod slidably moveable within said cylinder.

5. An outboard drive unit as recited in claim 4, wherein said tilt cylinder device is so arranged as not to extend during normal operation of said marine vessel by said outboard drive unit but to extend upon collision with an underwater obstacle.

6. An outboard drive unit as recited in claim 1, further comprising a first connecting pin for connecting said tilt cylinder device at one end to said clamp bracket, and a second connecting pin for connecting said tilt cylinder device at the other end to said swivel bracket.

7. An outboard drive unit as recited in claim 6, wherein said tilt cylinder device includes a cylinder, a piston and a rod slidably moveable within said cylinder.

8. An outboard drive unit as recited in claim 7, wherein said tilt cylinder device is so arranged as not to extend during normal operation of said marine vessel by said outboard drive unit but to extend upon collision with an underwater obstacle.

9. An outboard drive unit as recited in claim 7, wherein said tilt cylinder device includes means for dampening the shock to the outboard drive unit upon collision with an underwater obstacle.

10. An outboard drive unit as recited in claim 1, wherein the shortest distance between the pivotal connection of said tilt cylinder device to said swivel bracket and said tilt axis is greater than the shortest distance between the pivotal connection of said tilt cylinder device to said clamp bracket and said tilt axis.

11. An outboard drive unit carrying propelling means for propelling a marine vessel having a hull through the water, said outboard drive unit further comprising, a clamp bracket attached to the hull of said vessel, a tilt shaft, a swivel bracket rotatably secured to said clamp bracket by said tilt shaft about a tilt axis, a stop pin secured to said clamp bracket for setting the downward position of said swivel bracket, and a tilt cylinder device pivotally connected at one end to said swivel bracket and pivotally connected at the other end to said clamp bracket, the perpendicular distance from said tilt axis to a line extending between said pivotal connections being greater than the shortest distance between said tilt axis and the position where said stop pin is secured to said clamp bracket for decreasing the stress acting on the tilt cylinder device and its associated parts, said tilt cylinder device being adapted to maintain the drive unit in the downward position when the propelling means of the drive unit is operated in reverse.

12. An outboard drive unit as recited in claim 11, wherein said tilt cylinder device is positioned so that said stop pin is not obstructive to the removal of said tilt cylinder device.

13. An outboard drive unit as recited in claim 12, further comprising a first connecting pin for connecting said tilt cylinder device at one end to said clamp bracket, and a second connecting pin for connecting said tilt cylinder device at the other end to said swivel bracket.

14. An outboard drive unit as recited in claim 13, where said tilt cylinder device includes a cylinder, a piston, and a rod slidably moveable within said cylinder.

15. An outboard drive unit as recited in claim 14, wherein said tilt cylinder device is so arranged as not to extend during normal operation of said marine vessel by said outboard drive unit but to extend upon collision with an underwater obstacle.

16. An outboard drive unit as recited in claim 11, further comprising a first connecting pin for connecting said tilt cylinder device at one end to said clamp bracket, and a second connecting pin for connecting said tilt cylinder device at the other end to said swivel bracket.

17. An outboard drive unit as recited in claim 16, wherein said tilt cylinder device includes a cylinder, a piston and a rod slidably moveable within said cylinder.

18. An outboard drive unit as recited in claim 17, wherein said tilt cylinder device is so arranged as not to extend during normal operation of said marine vessel by said outboard drive unit but to extend upon collision with an underwater obstacle.

19. An outboard drive unit as recited in claim 17, wherein said tilt cylinder device includes means for dampening the shock to the outboard drive unit upon collision with an underwater obstacle.

20. An outboard drive unit as recited in claim 11, wherein the shortest distance between the pivotal connection of said tilt cylinder device to said swivel bracket and said tilt axis is greater than the shortest distance between the pivotal connection of said tilt cylinder device to said clamp bracket and said tilt axis.

* * * * *